US007687980B2

(12) United States Patent
Kim

(10) Patent No.: US 7,687,980 B2
(45) Date of Patent: Mar. 30, 2010

(54) SPARK PLUG

(76) Inventor: Nam-Pyong Kim, #335-22 Mochung-dong, Heungdeok-gu, Cheongjoo-shi, Chungcheongbuk-do, 361-807 (KR)

( * ) Notice: Subject to any disclaimer, the term of this patent is extended or adjusted under 35 U.S.C. 154(b) by 237 days.

(21) Appl. No.: 11/718,944

(22) PCT Filed: Nov. 23, 2005

(86) PCT No.: PCT/KR2005/003964

§ 371 (c)(1),
(2), (4) Date: May 9, 2007

(87) PCT Pub. No.: WO2006/062302

PCT Pub. Date: Jun. 15, 2006

(65) Prior Publication Data

US 2008/0088216 A1 Apr. 17, 2008

(30) Foreign Application Priority Data

Dec. 6, 2004 (KR) ..... 10-2004-0101623

(51) Int. Cl.
*H01T 13/20* (2006.01)

(52) U.S. Cl. ..... 313/142; 313/141; 313/143

(58) Field of Classification Search ..... 313/118–145; 123/169 R, 169 EL, 32, 41, 310
See application file for complete search history.

(56) References Cited

U.S. PATENT DOCUMENTS

| | | | | |
|---|---|---|---|---|
| 5,430,346 | A * | 7/1995 | Johnson | 313/139 |
| 6,013,973 | A * | 1/2000 | Sato | 313/143 |
| 6,362,562 | B1 * | 3/2002 | Rossi | 313/141 |
| 6,538,366 | B1 * | 3/2003 | Drecq | 313/141 |

* cited by examiner

*Primary Examiner*—Peter J Macchiarolo
*Assistant Examiner*—Donald L Raleigh
(74) *Attorney, Agent, or Firm*—Park & Associates IP Law LLC

(57) ABSTRACT

A spark plug comprises: a spark plug housing; an axial core electrode disposed in a longitudinal direction in the spark plug housing; and a ground electrode having a terminal part spaced apart along the longitudinal direction from a distal end of the axial core electrode and disposed in a perpendicular relation with the axial core electrode, the terminal part having a circular through hole formed along an axis coaxial with the axial core electrode, the circular through hole having a tapered inner surface and including a plurality of spiral protrusions disposed on the tapered inner surface to induce a turbulent air flow in the combustion inflow.

4 Claims, 5 Drawing Sheets

SPARK PLUG

REFERENCE TO RELATED APPLICATIONS

This is a National Stage entry of pending International Application PCT/KR2005/003964 filed on Nov. 23, 2005, which designates the United States and claims priority of Korean Patent Application No. 10-2004-0101623 filed on Dec. 6, 2004.

FIELD OF THE INVENTION

The present invention relates to a spark plug and in particular to an improved spark plug which is capable of significantly enhancing a spark spreading efficiency and a combustion efficiency when used at an engine.

BACKGROUND OF THE INVENTION

Generally, as shown in FIG. 3, a side surface ground electrode 12 of a spark plug 11 is bent in a L-shape being perpendicular with respect to an axial core direction, so that a discharge part 14 facing an axial core electrode 13 is formed in a rectangular shape.

When a discharge spark occurs at the spark plug, a spark occurs between the axial core electrode 13 and a discharge end part 14 of the ground electrode 12 disposed below the axial core electrode 13. A mixed gas in a space 15 formed by the electrodes is combusted by spark, so that a compressed mixed gas is exploded in a cylinder. In the conventional art, a high pressure air generated by the explosion may be blocked by the discharge end part 14, so that a combustion spreading effect with respect to an air combustion mixed gas in a combustion chamber is not good.

When a residual carbon remains in the space formed by the electrodes, the carbons may be accumulated and be changed from a particle phase to a chain phase at the surfaces of the electrodes 13 and 14, so that a short circuit may occur between the electrodes 13 and 14. In this state, even when voltage is supplied, spark may not occur for thereby producing serious problems, so that an engine may stop or mixed gas is outputted to an exhaust pipe in a state it is not combusted. As non-combusted gas is outputted to an exhaust pipe, a backfire phenomenon frequently occurs, so that an abnormal phenomenon and a combustion efficiency decrease problem occur.

When a time of use passes, a crack may occur at a discharge concentration portion of the front end of the axial core electrode 13 due to corrosion, so that a critical damage occurs. The life span of the spark plug may decrease due to an unbalanced abrasion.

As shown in FIGS. 4 and 5, so as to overcome the above problems, there is provided a spark plug 26 which includes an axial core electrode 21 adapted to make spark, and a side surface ground electrode 25 which is opposite to the axial core electrode 21 with the side surface ground electrode 25 being disposed with a spark space 22 from the axial core electrode 21, and with a discharge end part 23 of the side surface ground electrode 25 being formed in a circular shape and having a center circular hole 24. A cap 27 of which part is opened is formed at the circular discharge end part 23 of the spark plug 26, and a plurality of protrusions 28 are formed at a circular inner side surface of the circular discharge front end part 23 in a circular shape. With the above construction, when a discharge spark occurs at the spark plug, a fast moving high pressure passes through the center circular hole 24 among the discharge end portion 23 of the ground electrode 25, the residual carbons are quickly sprayed from the space 22 between the electrodes 21 and 25, so that the residual carbons are not accumulated at a the discharge surfaces of the electrodes for thereby enhancing the efficiency of use and extending the life span of the products. In addition, the side surface ground electrode 25 is designed to effectively spreading heat energy occurring during a spark and explosion combustion from the circular discharge end part 23, so that the area of the spark generation may increase.

However, the spark plug having the circular discharge end part 23 is known to slightly prevent the problem that the carbons are accumulated on the surfaces of the electrodes. In addition, if the compressed mixed gas in the spark space 22 between the electrodes 21 and 25 is not uniformly distributed, the spark spreading speed and combustion efficiencies significantly decrease. The above problems occur because the sparks occurring at the spark plug do not affect the uniformly distributed mixed gas. The protrusions 28 formed at the inner side of the circular discharge end part 23 are formed with simple structures, so that the accumulated carbons can not be effectively removed from the surfaces of the electrodes because the sparks are spread in a straight line shape.

SUMMARY OF THE INVENTION

Accordingly, it is an object of the present invention to provide a spark plug which overcomes the problems encountered in the conventional art. It is another object of the present invention to provide a spark plug in which a spark spreading efficiency is significantly enhanced by providing a mixer at a space part formed between electrodes, with the space part largely affecting a spark spreading efficiency during a compression stroke of an engine, and with the mixer being provided with a function of generating turbulent flow.

In addition, a combustion efficiency is largely improved based on an enhanced explosion force, so that the removal of carbons from the electrodes is effective, and the center electrodes are uniformly worn out.

To achieve the above objects, a spark plug comprises: a spark plug housing; an axial core electrode disposed in a longitudinal direction in the spark plug housing; and a ground electrode having a terminal part spaced apart along the longitudinal direction from a distal end of the axial core electrode and disposed in a perpendicular relation with the axial core electrode, the terminal part having a circular through hole formed along an axis coaxial with the axial core electrode, the circular through hole having a tapered inner surface and including a plurality of spiral protrusions disposed on the tapered inner surface so as to induce a turbulent air flow in the combustion inflow.

The circular through hole is tapered with the diameter of the circular through hole being increased in the direction of a lower side of the same. The diameter of an upper side of the circular through hole is about ⅔ of the diameter of the axial core electrode.

DETAILED DESCRIPTION OF THE INVENTION

The construction of the present invention will be described with reference to the accompanying drawings.

Figure 1:
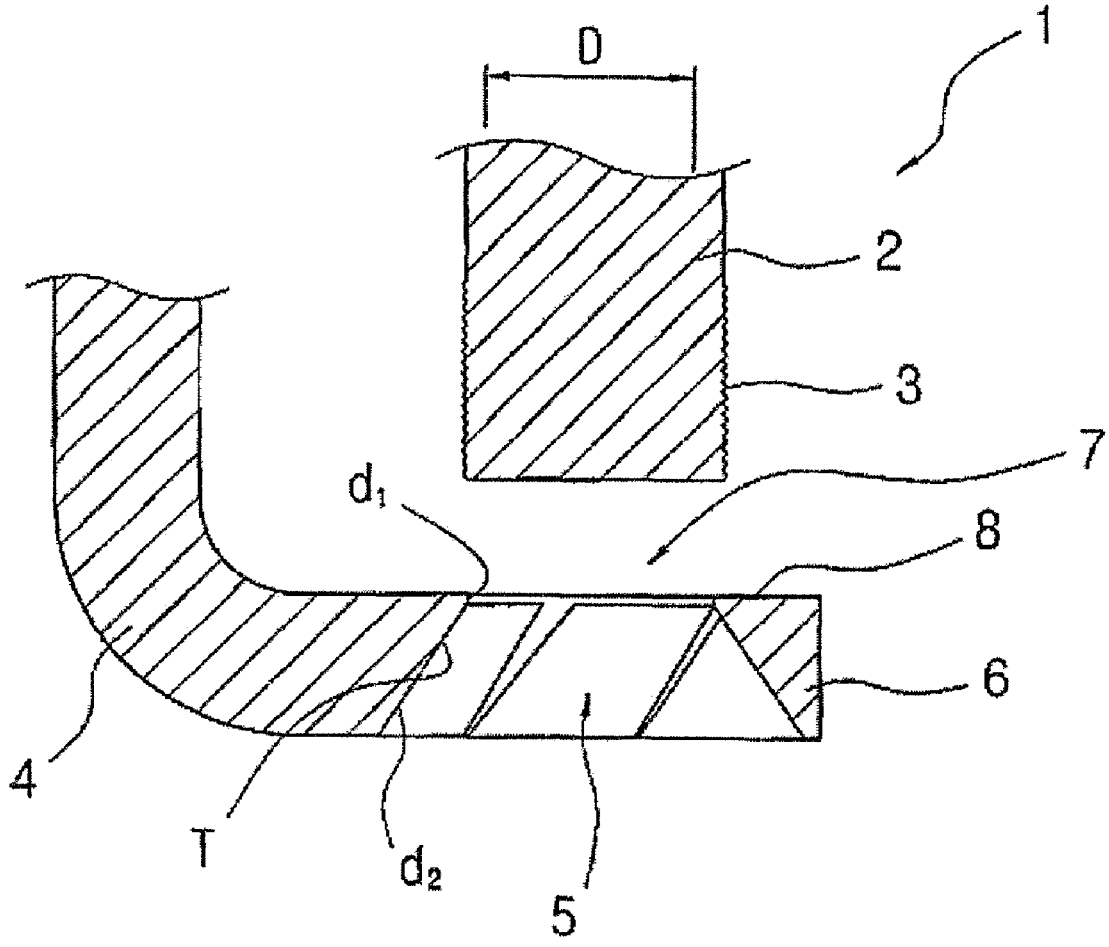
FIG. 1 is an enlarged front cross sectional view illustrating a distal portion of a spark plug according to the present invention.
Figure 2:
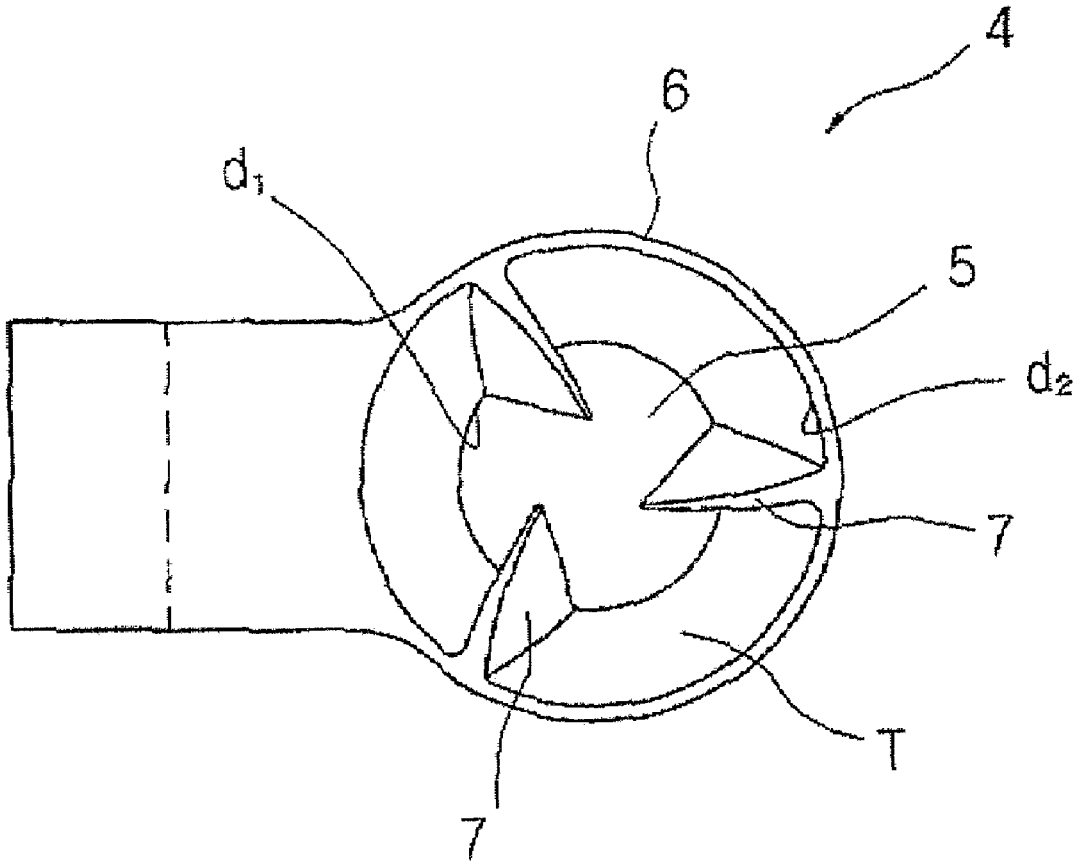
FIG. 2 is a bottom view illustrating a ground electrode of a spark plug according to the present invention.
Figure 3:
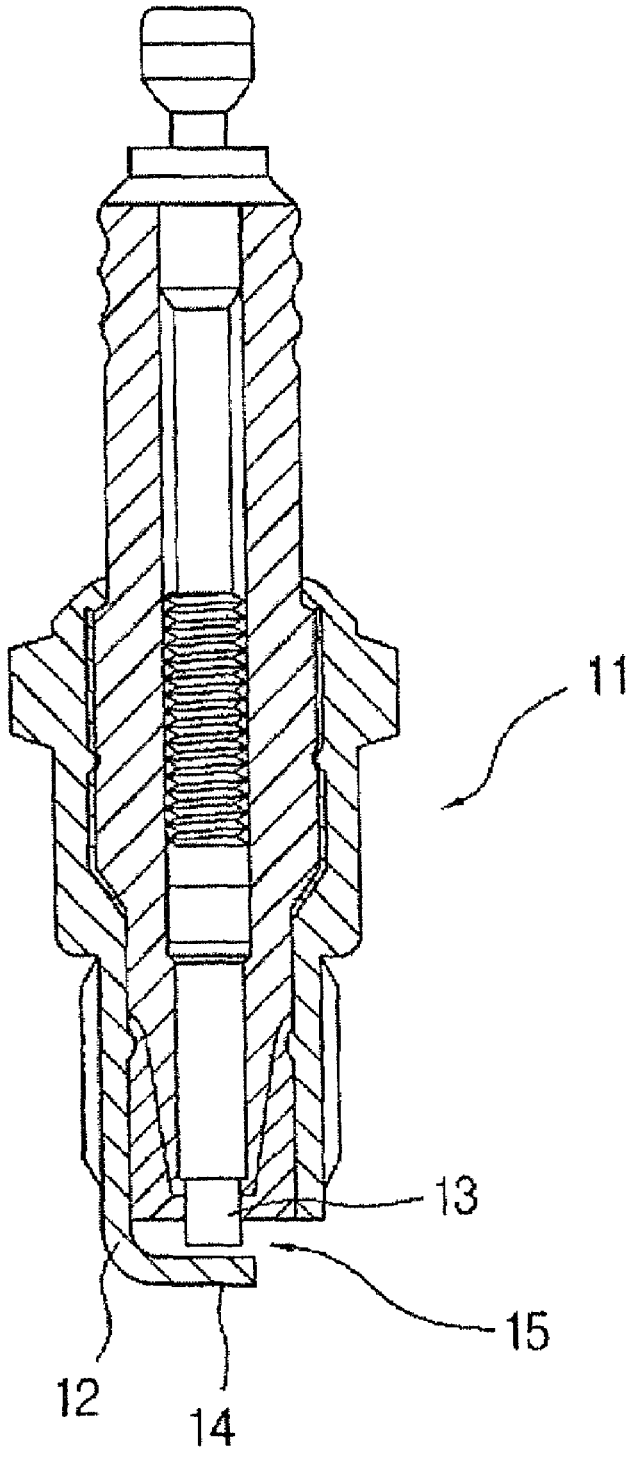
FIG. 3 is a view illustrating one conventional spark plug.
Figure 4:
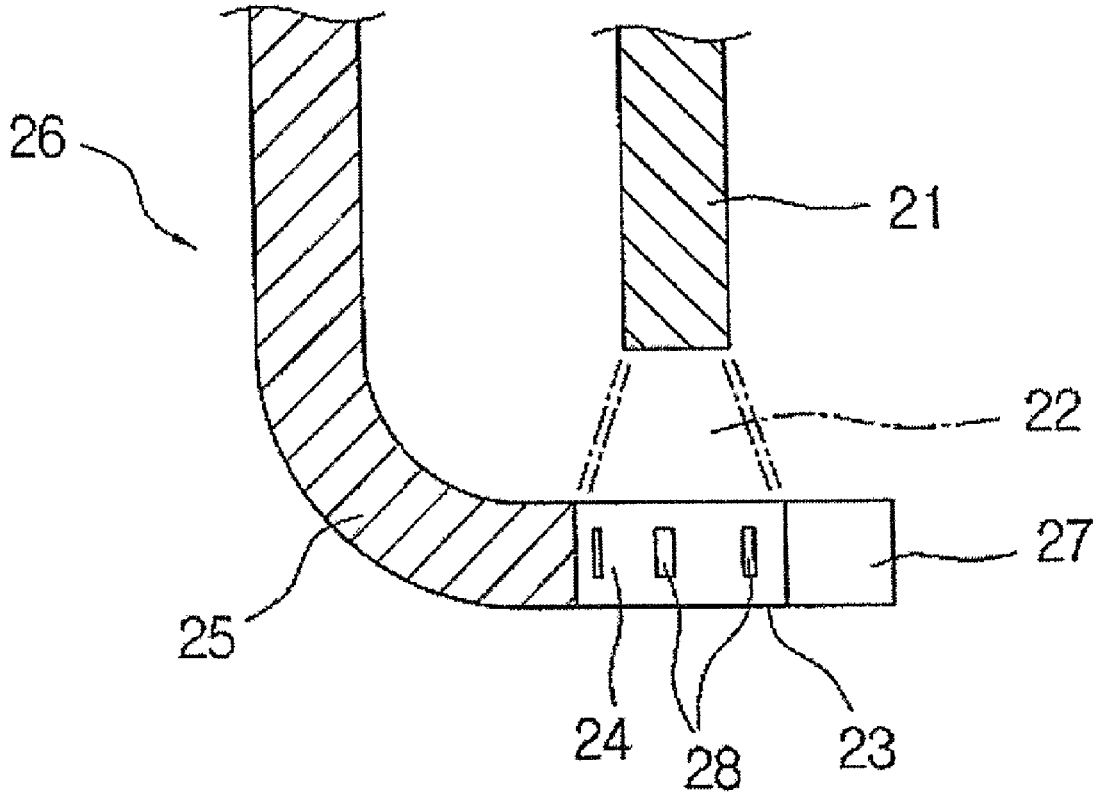
FIGS. 4 and 5 are views illustrating another conventional spark plug.
Figure 5:
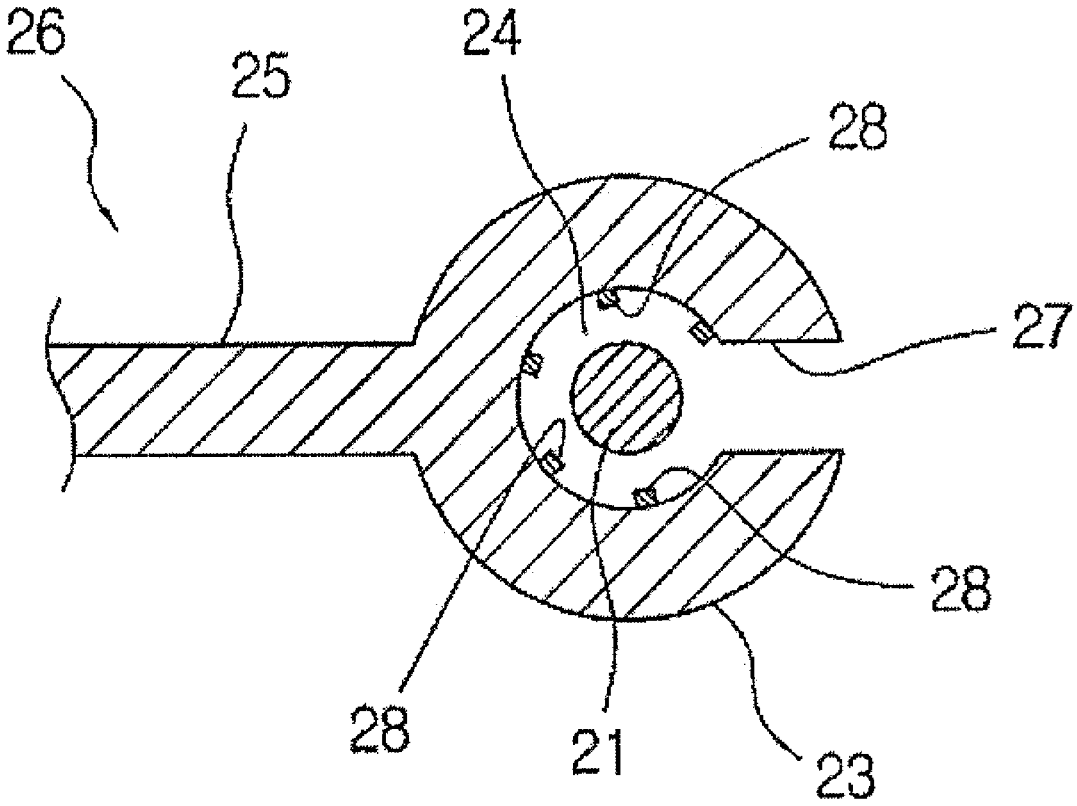

FIG. 1 is an enlarged front cross sectional view illustrating a distal portion of a spark plug according to the present invention, and FIG. 2 is a bottom view illustrating a ground electrode of a spark plug according to the present invention.

When describing the present invention, the elements same as the conventional art except for the electrodes will be referred to the conventional art. Protrusions 3 are formed at a lower surface of an axial core electrode 2 of a spark plug 1 and are protruded like a construction that small sand particles are protruded by a knurling cutting process so as to enhance a discharge effect. A terminal part 6 of circular shape is formed at a discharge end part of a ground electrode 4 installed at a lower side of the axial core electrode 2 and includes a circular through hole 5 surrounding a space meeting an extended line of the axial core electrode 2. The terminal part 6, which is the discharge ends of the axial core electrode 2 and the ground electrode 4, is distanced with respect to a spark forming space 7.

The diameter of the circular through hole 5 of the terminal part 6 is slightly smaller than the diameter of the axial core electrode 2. The circular through hole 5 can have the same diameter with respect to the entire wall thickness, but it is preferably formed in a shape of a tapered horn-shaped hole.

The circular through hole 5 is formed in a tapered hole shape of which an upper portion (contacting with a spark forming space) formed at the side of the axial core electrode 2 has a small diameter part (d1), and the diameter increases in the direction of the lower side (combustion chamber side), so that a large diameter part (d2) is formed at the lower surface. A plurality of spiral protrusions 7 are protruded from the tapered inner surface T of the circular through hole 5 and have twisted shapes like the blades of an electric fan mounted on a wall of a building, for example.

In addition, the small diameter part (d1) of the tapered circular through hole 5 is about ⅔ of the diameter (D) of the axial core electrode 2. The small diameter part (d1) is smaller than the axial core electrode 2 so as to allow the axial core electrode 2 to generate spark so that the spark is collided with a discharge surface 8 for thereby improving a shape of discharge. The gas compressed during the compression stroke of the engine according to the present invention is inputted into the side of the spark plug 1 which corresponds to the upper side of the combustion chamber. At this time, the mixed compression gas is guided by the tapered circular through hole 5 and is further compressed and collided with the spiral protrusions 7 for thereby generating a turbulent flow and is flown into the spark forming space 7 between the electrodes 2 and 4.

In the compression gas inputted into the spark forming space 7 the fuel and combustion air is uniformly mixed, and the fuel is transformed into micro particles.

When the spark plug 1 operates after the compression stroke is finished, the spark occurs between the electrodes 2 and 4, which are in electrically conductive states, and spark occurs at the compression gas. The flow of spark is guided by the tapered hole 5, which becomes more widening, and is spread widely in the interior of the cylinder. The spark is spirally flown by the spiral protrusions 7, so that a stronger explosion occurs than that of the conventional art. The carbons accumulated at the spiral protrusions 7, the tapered surface T of the circular through hole 5 and the discharge surface 8 can be easily removed by the turbulent flow of the mixer and the combustion gash which strongly occurs during the explosion by the compression and spark.

As described above, a terminal part having a circular through hole is formed at the discharge end part of the ground electrode which is disposed opposite to the axial core electrode, and a plurality of spiral protrusions are protruded from the inner surface of the terminal part in the direction of the circular through hole, so that the compressed gas flows in a turbulent shape and is inputted into the spark forming space, so that the gas is uniformly mixed and is changed to micro-sized particles, whereby a spark spreading efficiency is enhanced, and a perfect combustion is achieved, and thereby significantly improving a combustion effect.

In addition, since a strong turbulent is formed by the spiral protrusions 7 during the compression and spark strokes, so that carbons accumulated at the electrodes are removed. It is possible to prevent unstable sparks. The axial core electrode and the ground electrode are uniformly worn out. The life span of the spark plug can be significantly enhanced.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A spark plug comprising:

a spark plug housing;

an axial core electrode disposed in a longitudinal direction in the spark plug housing; and a ground electrode having a terminal part spaced apart along the longitudinal direction from a distal end of the axial core electrode and disposed in a perpendicular relation with the axial core electrode, the terminal part having a circular through hole formed along an axis coaxial with the axial core electrode, the circular through hole having a tapered inner surface and including a plurality of spiral protrusions disposed on the tapered inner surface.

2. The spark plug of claim 1, wherein the circular through hole has the tapered inner surface throughout an entire length of the circular through hole, with the diameter of the tapered, circular through hole increasing gradually in the direction toward the lower side of the terminal part.

3. The spark plug of claim 2, wherein the diameter of an upper side of the tapered, circular through hole is about two thirds (⅔) of the diameter of the axial core electrode.

4. The spark plug of claim 1, wherein the axial core electrode includes small protrusions at a lower circumferential surface thereof.

* * * * *